US011454476B2

(12) United States Patent
Bolen et al.

(10) Patent No.: US 11,454,476 B2
(45) Date of Patent: Sep. 27, 2022

(54) TURRET WITH RETRACTABLE PROTECTIVE ROOF

(71) Applicant: CMI Defence S.A., Loncin (BE)

(72) Inventors: Philippe Bolen, Angleur (BE); Paul Lewandowski, Haneffe (BE); Sebastien Matthys, Wihogne (BE)

(73) Assignee: CMI DEFENCE S.A., Loncin (BE)

( * ) Notice: Subject to any disclaimer, the term of this patent is extended or adjusted under 35 U.S.C. 154(b) by 0 days.

(21) Appl. No.: 17/296,988

(22) PCT Filed: Nov. 12, 2019

(86) PCT No.: PCT/EP2019/080938
§ 371 (c)(1),
(2) Date: May 26, 2021

(87) PCT Pub. No.: WO2020/108976
PCT Pub. Date: Jun. 4, 2020

(65) Prior Publication Data

US 2022/0026178 A1 Jan. 27, 2022

(30) Foreign Application Priority Data

Nov. 28, 2018 (EP) ..... 18208946

(51) Int. Cl.
*F41H 5/22* (2006.01)
*F41H 5/20* (2006.01)
*F41H 7/04* (2006.01)

(52) U.S. Cl.
CPC ..... *F41H 5/20* (2013.01); *F41H 5/223* (2013.01); *F41H 7/04* (2013.01)

(58) Field of Classification Search
CPC ..... F41H 5/22; F41H 5/223
See application file for complete search history.

(56) References Cited

U.S. PATENT DOCUMENTS 3,800,659 A 4/1974 Kuiper
4,646,616 A 3/1987 Svensson
(Continued)

FOREIGN PATENT DOCUMENTS

DE 736470 C 6/1943
EP 1361409 A2 11/2003
(Continued)

*Primary Examiner* — J. Woodrow Eldred
(74) *Attorney, Agent, or Firm* — Leydig, Voit & Mayer, Ltd.

(57) ABSTRACT

An armoured vehicle turret that can accommodate a crew including a gunner includes: a fixed roof with an opening; a retractable protection system having an armoured cover or dome, that is pivotably movable about a horizontal axis and/or in vertical translation, the retractable protection system being capable of assuming: a first position in which the retractable protection system is retracted against the roof and ensures a closing of the opening; a second partial open position in which the retractable protection system is partially deployed in vertical translation upwards so as to protect a soldier in an observation position; a third partial open position in which the retractable protection system is partially deployed in vertical translation upwards more so than in the second position, so as to protect the soldier in a sniper position; and a fourth fully open position in which the retractable protection system is fully deployed.

11 Claims, 3 Drawing Sheets

(56) References Cited

U.S. PATENT DOCUMENTS

| | | | | |
|---|---|---|---|---|
| 8,146,479 | B2 | 4/2012 | Cazalieres et al. | |
| 8,393,258 | B2 | 3/2013 | Cazalieres et al. | |
| 2004/0237764 | A1* | 12/2004 | Crotty ..... | F41H 5/223 89/36.08 |

FOREIGN PATENT DOCUMENTS

| | | | |
|---|---|---|---|
| EP | 2386818 | A1 | 11/2011 |
| FR | 2563901 | A1 | 11/1985 |
| FR | 2936305 | B1 | 10/2010 |
| WO | WO 2014127769 | A1 | 8/2014 |

* cited by examiner

TURRET WITH RETRACTABLE PROTECTIVE ROOF

CROSS-REFERENCE TO PRIOR APPLICATIONS

This application is a U.S. National Phase application under 35 U.S.C. § 371 of International Application No. PCT/EP2019/080938, filed on Nov. 12, 2019, and claims benefit to European Patent Application No. EP 18208946.6, filed on Nov. 28, 2018. The International Application was published in French on Jun. 4, 2020 as WO 2020/108976 under PCT Article 21(2).

FIELD

The present invention relates to the technological field of the integration of a protection system such as a sunroof with different functionalities or a retractable cover or dome attached to the rotatable turret of an ordinary armoured vehicle.

The present invention more particularly relates to a retractable protection system in the form of a dome, in order to replace a flap or hatch, i.e. a panel that is generally pivoting and adapted to open and close an opening provided in the roof of a turret.

BACKGROUND

At the present time, for example in the context of urban involvement, the gunner soldier must stand through the opening provided by the turret hatch in order to position him/herself for passive observation with binoculars (and not with the episcope) or during a situation under enemy fire. The gunner is then exposed to the enemy without protection. Surely hatches do usually have a vertical edge of at least 40 cm high, but it is not enough to protect the gunner. They also offer some dorsal protection to the gunner via the hatch door but no protection is provided against shots coming from the front, the side and especially from above.

Light armoured vehicles of the SUV or 4×4 type can also be found, having a cupola on the roof, which may consist of a single flap on the roof with two hinged doors, through which an automatic weapon can be deployed and where the gunner can stand. In this case too, the gunner only has partial and very relative side protection (see e.g. U.S. Pat. No. 3,800,659).

The principle of a shell that rises and exposes a weapon system is very old. In eclipse turrets (e.g. Galopin turret, 1889), a firing chamber with an armoured protective dome is fixed to a column acting as a pivot. When firing, the firing chamber is raised above ground to expose the muzzle of two barrels. After firing, the firing chamber sinks so that the lowered dome connects to the surrounding structures. The pivot column can move in the vertical direction, it is moved by the motion of a balance provided with a counterweight. It can also rotate to position the barrel according to the aim. This principle of the eclipse turret, however, was never applied to armoured vehicles.

Document FR 2,936,305 B1 discloses a light turret that is rotatably mounted on a platform which may be a vehicle and intended to support a weapon system such as a grenade launcher. The cupola is retractably mounted and comprises manual actuation means allowing to deploy it above the platform and to bring it into firing position. The cupola is provided with a protective cover for the weapon system closing a chamber, the latter located under the platform.

Document U.S. Pat. No. 8,146,479 B2 by the same Applicant, discloses a retractable light turret mounted on a platform, comprising a firing means that can be deployed through an opening, a protective cover ensuring the closure of the opening, elevation and azimuth aiming means for the firing means, in which said protective cover has an external surface with close-in defence means and at least one observation means coupled to a display means arranged inside the platform.

These systems are remotely operated and do not allow a soldier to stand there upright for firing or observation.

Document WO 2014/127769 A1 discloses a shielded vehicle with a vehicle cabin on which a roof cover is arranged, the roof cover being arranged pivotably and in translation relative to the vehicle cabin. The pivoting motion occurs relative to a longitudinal axis of the vehicle and the translational motion can occur along an external contour of the bodywork with, for example, a vertical guide allowing to fold the roof cover downwards along the vehicle cabin, in a transport position.

EP 1361409 A2 discloses a shielded vehicle comprising a hatch located on top of the vehicle and hinged at its rear edge on the vehicle body so as to pivot between a closed position (I) covering a manhole provided in the vehicle body and an open position (II), in which the door allows passage into and out of the vehicle through the manhole, said hatch being provided with observation means allowing limited visibility outside the vehicle, when the access hatch is in the closed position (I) and comprising a windscreen fitted with a front window and side windows hinged on either side of the front window so as to pivot relative to the front window, so that the windshield can be disposed in a storage position (A) or in an operating position (B), in which storage position (A) the side windows are turned on the front window whereas in the operating position (B), the front window and side windows extend in the gap between the body and the access hatch in a partially opened position (III), providing better visibility out of the vehicle than the limited visibility obtained through the above-mentioned observation means. The vehicle body is provided with storage space for stowing the windshield.

SUMMARY

In an embodiment, the present invention provides an armoured vehicle turret that can accommodate a crew including a gunner, comprising: a fixed roof with an opening; a retractable protection system comprising an armoured cover or dome, that is pivotably movable about a horizontal axis and/or in vertical translation, the retractable protection system being configured to assume: a first position in which the retractable protection system is retracted against the roof and ensures a closing of the opening; a second partial open position in which the retractable protection system is partially deployed in vertical translation upwards so as to protect a soldier in an observation position; a third partial open position in which the retractable protection system is partially deployed in vertical translation upwards more so than in the second position, so as to protect the soldier in a sniper position; and a fourth fully open position in which the retractable protection system is fully deployed by pivoting and/or upward vertical translation uncovering the opening to allow evacuation of the crew; and a motion mechanism ensuring motion of the retractable protection system between the first position, second partial open position, third partial open position, and fourth fully open position, wherein, in the second partial open position, the retractable protection system uncovers a lateral peripheral space closed by protective loophole plates so as to permit the soldier to take an observation position of up to 360°.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
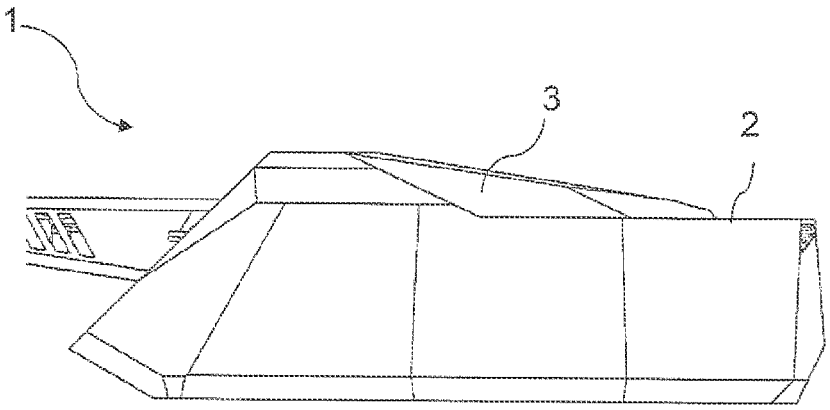
FIG. 1 schematically shows a side view of a turret according to the invention, with the retractable protection system in the closed position.

In an embodiment, the present invention aims to overcome the drawbacks of the prior art.

In particular, the present invention aims to achieve the turret of a shielded vehicle with a collapsible or retractable protection system, allowing to protect a soldier standing either in dodger firing position with light weaponry ("sniper") partially outside the turret, or in a visual observation position in the open air, but protected and unhindered, without the need for hatches or episcopes.

More specifically, the present invention aims to provide a retractable protection system that also serves as a hatch for opening and closing an opening provided in the roof of the turret allowing the gunner to securely and instantly come to a firing position using a retractable and possibly miniaturized ballistic system.

The retractable system according to the present invention should therefore act as an access to the opening provided in the turret as well as protect the user.

Key (1) armoured turret
(2) roof of the tank turret
(3) retractable protection system
(4) weapon protection support (micro-perforated band)
(5) opening (passage)

The present invention relates to an armoured vehicle turret accommodating a crew which a gunner, comprising a fixed roof with an opening and a retractable protection system in the form of a shielded cover or dome that can be moved pivotably about a horizontal axis and/or in vertical translation, wherein:

the retractable armoured cover or dome can assume at least four positions, a first position in which the retractable system is retracted against the roof and ensures the closing of the opening, a second partial opening position in which the retractable system is partially deployed in vertical translation upwards and allows to protect a soldier in an observation position, a third partially open position in which the retractable system is partially deployed in vertical translation upwards, but more so than in the second position, and allows to protect a soldier in sniper position and a fourth position of complete opening in which the retractable system is fully deployed by pivoting and/or vertical translation upwards by uncovering the opening in order to allow the evacuation of the crew;

the turret is provided with a mechanism ensuring, in use and as required, the motion of the retractable protection system between the four above-mentioned positions.

According to particular embodiments of the invention, the turret comprises at least one (or a suitable combination of several) of the following characteristics:

in the second position, the retractable dome uncovers a side peripheral space closed by protective loophole plates, allowing the soldier to take an observation position up to 360°;

in the third position, the retractable dome uncovers a side peripheral space that is larger than in the second position, leaving a free space over a certain height above the protective plates with loopholes, allowing the soldier to take a sniper position with light weaponry;

protective loophole plates are (micro)-perforated steel plates providing protection against projectiles of different calibres;

in the second and third positions, the protective loophole plates can be retracted downwards into the turret, for example by means of slides;

the motion mechanism of the protective dome is a lifting mechanism with cylinders and/or hinged or even a pantograph that can be actuated by the crew;

the motion mechanism is adapted to ensure the motion of the protective dome substantially parallel to itself between the first, retracted position, and the second and third positions, of partial deployment;

the motion mechanism is adapted to ensure the motion of the protective dome pivoting from the bottom up and forwards or backwards of the turret, between the third position of partial deployment and the fourth fully-deployed position to provide shield-type front or rear protection for the crew evacuating the turret through the opening;

the motion mechanism of the retractable shielded dome is manually operable by mechanical means, for example hydraulic means and/or remotely controlled.

The present invention relates to a tank turret comprising a retractable protection system in the form of an armoured dome, integrated into said turret, having any dome shape, generally with a profile and a (semi)-circular or polygonal plane. An actuation system allows to raise the dome so that the gunner can get into position. In front of him/her is a support such as a micro-perforated band that protects the area below the weapon. In the present invention, the protective dome has above all a shield function.

According to an embodiment of the invention, shown on FIGS. 1 to 4, the turret 1 comprises a protection system in the form of a retractable roof 3 allowing to cover an opening 5, which must allow the passage of soldiers to enter or to evacuate the turret, and also allows a soldier to get in a sniper position with small weaponry or for visual observation, with the naked eye or with glasses.

According to the invention, the retractable protection system 3 can be moved between four different positions, as shown in FIGS. 1 to 4. For the sake of clarity, the means for lifting the dome are not shown.

In a first position, the system 3 completely closes the opening 5 so as to create a tight closure of the turret, as shown in FIG. 1. The protective dome with its structure is in retracted state, and is then partially masked in the cockpit. The gunner with weapon are locked inside the turret and are not visible from the outside.

Figure 2:
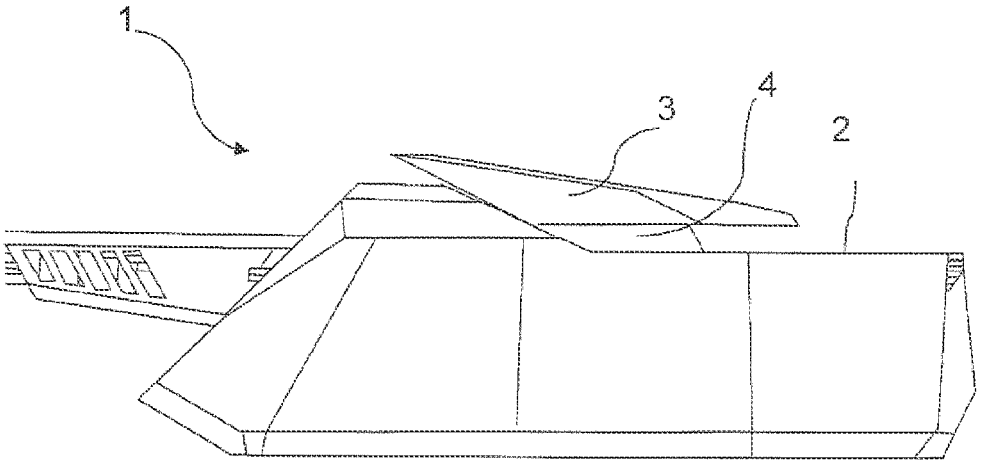
FIG. 2 schematically represents a side view of the turret with the retractable protection system in a first intermediate open position for the protection of a soldier in an observation position.

In a second position, which is also a first intermediate open position, the protection system 3 is slightly deployed and raised relative to the remainder of the turret, which allows the user to get into observation or watch position, with the naked eye or with binoculars (FIG. 2). In this configuration, the soldier or gunner is protected from above by the dome 3 which serves as a shield and is advantageously protected laterally at the level of the normally open part by the installation of protective plates allowing observation, as for example sheets having loopholes 4, preferably (micro)-perforated sheets ensuring protection against projectiles of different calibres.

Figure 3:
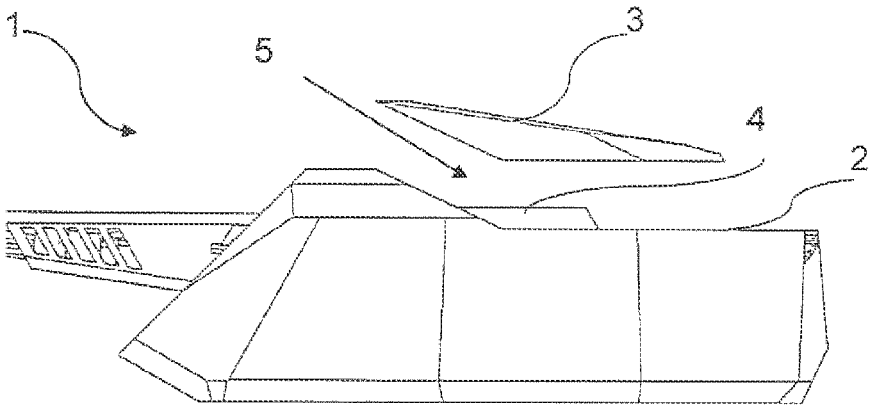
FIG. 3 schematically shows a side view of the turret with the retractable protection system in the second intermediate open position for the protection of a soldier in sniper position with light weaponry.

In a third position, which is also a second intermediate open position, the protection system 3 is even more deployed, which allows to uncover a side opening above the protective plates 4 (FIG. 3). This position advantageously allows the sniper/elite gunner ("sniper") to operate with a light weapon, such as pistol, rifle or machine gun, in asymmetric involvement situations. The gunner can pivot 360° and remain protected from possible enemy fire. In a particular embodiment, and to give more ease to the sniper, the protective loophole plates 4 can be lowered, for example by means of slides.

Figure 5:
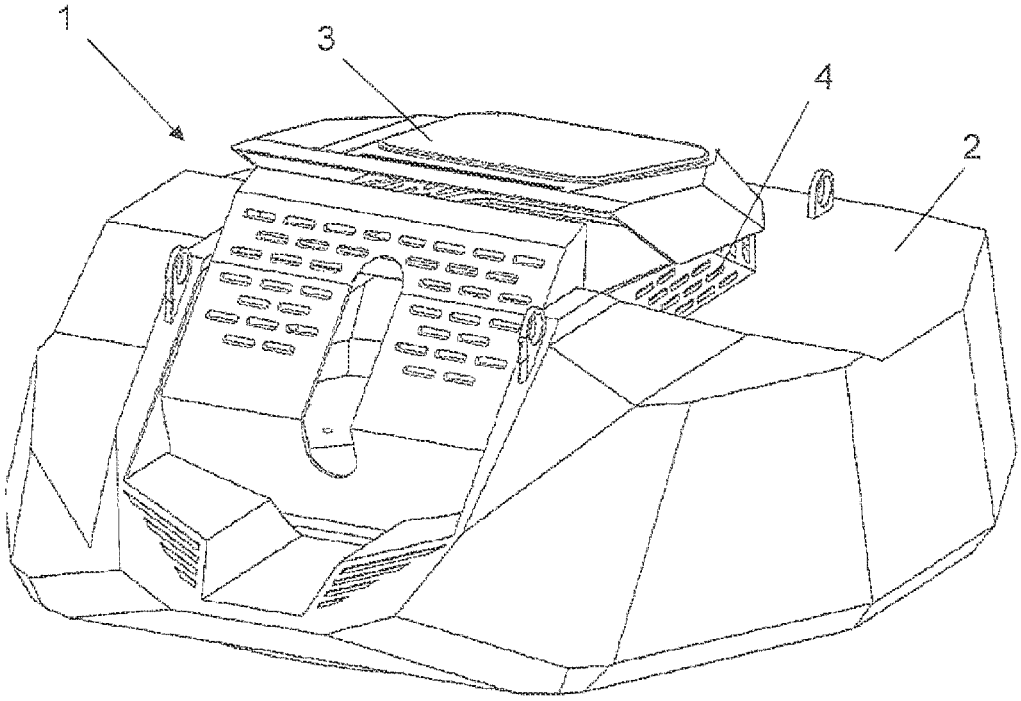
FIGS. 5 and 6 show a perspective view and a side view respectively of one embodiment of the turret according to the invention with a retractable protective system in the first intermediate open position, where the perforated protective sheets are shown in detail.
Figure 6:
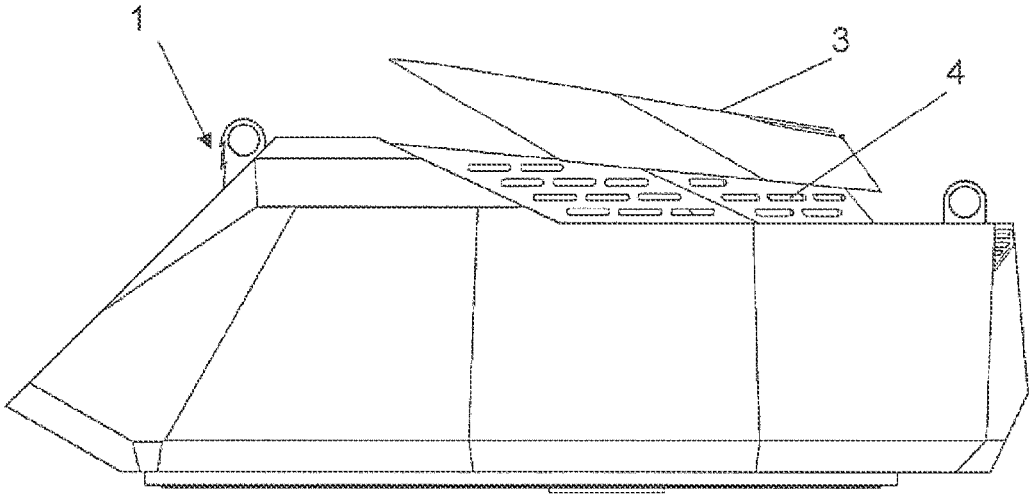

A particular embodiment of the perforated protective plate 4 is shown in FIGS. 5 and 6. The implementation of the loopholes (perforations) is known per se to the person skilled in the art.

In the fourth position, the protection system 3 is completely open, for example, but without this being limitative in the context of the present invention, by pivoting upwardly and forwardly, both allowing the user to stand up in the turret and having the protection system as a shield as shown in FIG. 3. In this fourth position, the gunner and other members of the crew may also evacuate the turret while being protected on one side by the dome 3 which is lifted to the maximum position.

The retractable system 3 according to the present invention thus has the function to open/close the opening 5 provided in the turret, such that a flap, and the function to protect users. In addition to the protection against enemies shooting, the dome also provides environmental protection, for example in protecting individuals against extreme temperatures (for example in the desert) by cutting incident radiation.

The retractable protection system 3 may also for example uncover the opening 5 by pivoting either towards the front side or towards the rear side of the turret, according to the situation.

The protection system according to the invention may assume four positions, allowing on one hand the protection of the user when in a firing or observation situation, and other hand allowing to open and close the access to the turret.

Figure 4:
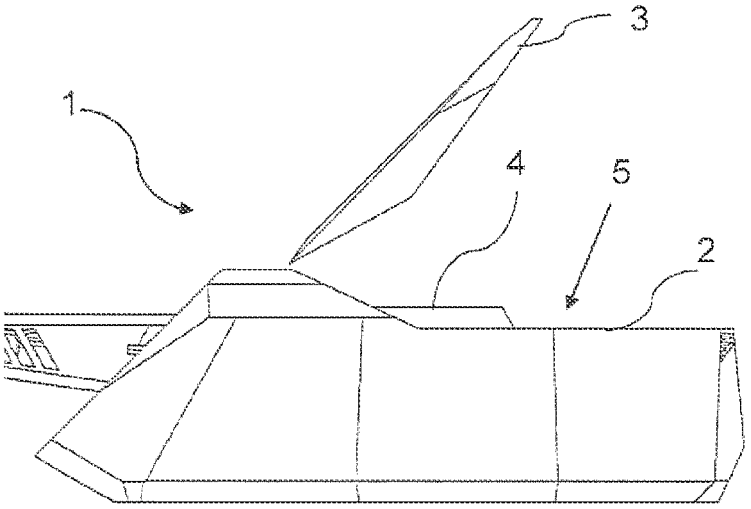
FIG. 4 schematically represents a side view of the turret with the protection system being completely open and/or in the evacuation position.

When the system is fully opened as shown in FIG. 4, the turret can be evacuated while protecting the crew thanks to the dome acting as a shield. On the other hand, this arrangement allows the crew to easily access the first floor of a building by exiting from the top of the turret, given that the roof of the latter is generally located at a certain height. The evacuation from the top can indeed present an advantage in specific situations.

When the system is placed in the protective position as shown by FIG. 2 or 3, the user is protected from all the projectiles thrown from the top. He/she is also posted in observation at a certain height, which allows better visibility, while being protected (effect "watchtower").

Another advantage of the invention is that it is possible to use the armoured vehicle in "peace keeping" mode (apparent crew), while maintaining the dome in the fourth position (fully extended), or even by removing the armoured dome.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An armoured vehicle turret that can accommodate a crew including a gunner, comprising:

a fixed roof with an opening;

a retractable protection system comprising an armoured cover or dome, that is pivotably movable about a horizontal axis and/or in vertical translation, the retractable protection system being configured to assume: a first position in which the retractable protection system is retracted against the roof and ensures a closing of the opening; a second partial open position in which the retractable protection system is partially deployed in vertical translation upwards so as to protect a soldier in an observation position; a third partial open position in which the retractable protection system is partially deployed in vertical translation upwards more so than in the second position, so as to protect the soldier in a sniper position; and a fourth fully open position in which the retractable protection system is fully deployed by pivoting and/or upward vertical translation uncovering the opening to allow evacuation of the crew; and a motion mechanism ensuring motion of the retractable protection system between the first position, second partial open position, third partial open position, and fourth fully open position, wherein, in the second partial open position, the retractable protection system uncovers a lateral peripheral space closed by protective loophole plates, so as to permit the soldier to take an observation position of up to 360°.

2. The turret of claim 1, wherein, in the third partial open position, the retractable protection system uncovers a greater lateral peripheral space than in the second partial open position, leaving a free space over a certain height above the protective loophole plates so as to allow the soldier to take the sniper position with a small weapon.

3. The turret according of claim 2, wherein the protective loophole plates comprise (micro) perforated steel plates providing protection against projectiles of different calibres.

4. The turret according of claim 3, wherein, in the second partial open position and the third partial open position, the protective loophole plates are retractable downwards into the turret.

5. The turret of claim 1, wherein the motion mechanism comprises a lifting mechanism with cylinders and/or a hinged lifting mechanism.

6. The turret according claim 5, wherein the motion mechanism is configured to ensure motion of the retractable protection system substantially parallel to the motion mechanism between the first, position, and the second and third partial open positions.

7. The turret according of claim 5, wherein the motion mechanism is configured to ensure motion of the retractable protection system pivoting from a bottom up and forwards or backwards of the turret, between the third partial open position and the fourth fully open position to provide shield-type protection at a front or at a rear for the crew evacuating the turret by the opening.

8. The turret according of claim 5, wherein the motion mechanism is actuatable manually, mechanically, and/or remotely.

9. The turret of claim 4, wherein, in the second partial open position and third partial open position, the protective loophole plates are retractable downwards into the turret by slides.

10. The turret of claim 5, wherein the hinged lifting mechanism comprises a pantograph actuatable by the crew.

11. The turret of claim 8, wherein the motion mechanism is actuatable mechanically, and wherein the motion mechanism is actuatable hydraulically.

* * * * *